US007607269B2

(12) United States Patent
Klein

(10) Patent No.: US 7,607,269 B2
(45) Date of Patent: Oct. 27, 2009

(54) INSIDE CORNER FRAMING ELEMENT FOR SUPPORTING WALLBOARD

(76) Inventor: James Alan Klein, 6200 19th Pl. SE., Bellevue, WA (US) 98006

( * ) Notice: Subject to any disclaimer, the term of this patent is extended or adjusted under 35 U.S.C. 154(b) by 84 days.

(21) Appl. No.: 11/682,189

(22) Filed: Mar. 5, 2007

(65) Prior Publication Data

US 2007/0125027 A1 Jun. 7, 2007

Related U.S. Application Data

(60) Provisional application No. 60/783,718, filed on Mar. 20, 2006, provisional application No. 60/818,859, filed on Jul. 7, 2006.

(51) Int. Cl.

| | |
|---|---|
| ***E04B 2/00*** | (2006.01) |
| ***E04B 7/00*** | (2006.01) |
| ***E04C 2/34*** | (2006.01) |
| ***E04H 14/00*** | (2006.01) |

(52) U.S. Cl. ..... 52/281; 52/287.1; 52/481.1; 52/241; 52/275

(58) Field of Classification Search ..... 52/481.1, 52/481.2, 241, 272, 281, 287.1, 254, 479, 52/779, 777, 275, 846

See application file for complete search history.

(56) References Cited

U.S. PATENT DOCUMENTS

| | | | | |
|---|---|---|---|---|
| 3,206,806 | A | 9/1965 | Powell | |
| 3,333,390 | A * | 8/1967 | Banning | 52/732 |
| 3,533,205 | A * | 10/1970 | Lankford et al. | 52/356 |
| 4,437,285 | A * | 3/1984 | Anderson et al. | 52/481 |
| 4,805,364 | A | 2/1989 | Smolik | |
| 4,854,096 | A | 8/1989 | Smolik | |
| 5,127,203 | A | 7/1992 | Paquette | |
| 5,127,760 | A | 7/1992 | Brady | |
| 5,881,520 | A | 3/1999 | Blazenvic | |
| 5,960,598 | A | 10/1999 | Tamlyn | |
| 6,260,318 | B1 * | 7/2001 | Herren | 52/317 |
| 6,332,296 | B1 | 12/2001 | Moscovitch | |
| 6,374,558 | B1 | 4/2002 | Surowiecki | |
| 6,609,344 | B2 * | 8/2003 | Saldana | 52/696 |
| 6,655,106 | B1 | 12/2003 | Sucre | |
| 6,748,705 | B2 | 6/2004 | Orszulak et al. | |
| 6,758,017 | B2 | 7/2004 | Young | |
| 7,028,444 | B2 | 4/2006 | Wirth | |
| 2003/0074849 | A1 | 4/2003 | Surowiecki | |
| 2003/0140592 | A1 | 7/2003 | Fjeld | |
| 2004/0003564 | A1 | 1/2004 | Surowiecki | |

OTHER PUBLICATIONS

American Iron & Steel Institute, Builders' Steel Stud Guide, RG-9607, Oct. 1996.

* cited by examiner

*Primary Examiner*—Robert J Canfield
*Assistant Examiner*—Babajide Demuren
(74) *Attorney, Agent, or Firm*—Thomas E. Loop

(57) ABSTRACT

The present invention is directed to an inside corner framing element for supporting wallboard at the intersection of two adjoining walls made from sheet metal framing members. The inside corner framing element may be characterized as either: (1) an elongated sheet metal strip bent lengthwise two times to define a truncated W-shaped cross-sectional profile with at least one linear receiving slot positioned at an end of the elongated sheet metal strip; or (2) an elongated sheet metal strip bent lengthwise three times to define a W-shaped cross-sectional profile with at least one linear receiving slot positioned at an end of the elongated sheet metal strip.

11 Claims, 17 Drawing Sheets

INSIDE CORNER FRAMING ELEMENT FOR SUPPORTING WALLBOARD

CROSS-REFERENCE TO RELATED APPLICATIONS

This application claims the benefit of U.S. Provisional Application No. 60/783,718 filed on Mar. 20, 2006, and U.S. Provisional Application No. 60/818,859 filed on Jul. 7, 2006, with both applications being incorporated herein by reference in their entireties for all purposes.

TECHNICAL FIELD

The present invention relates generally to interior building wall constructions, and more particularly, to sheet metal framing elements and related structures configured to provide a backing or support surface for wallboard at an inside corner formed at the intersection of two adjoining steel framed walls, as well as to methods of making and using the same.

BACKGROUND OF INVENTION

Interior wall constructions using steel framing members is well-known. Steel framing members are generally made by roll-forming 12 to 25 gauge galvanized sheet steel. As is appreciated by those skilled in the art, steel framed wall constructions commonly include horizontal header and footer channel tracks having a plurality of matching vertical studs therebetween. Although many cross-sectional shapes are available, the primary shapes used in steel framed wall constructions are C-shaped studs and U-shaped channel tracks (see, e.g., prior art FIGS. 1 and 2; Builders' Steel Stud Guide, American Iron and Steel Institute, Publication RG-9607, October, 1996).

An advantage of steel wall construction is not only strength and fire resistance, but also ease of assembly. For example, C-shaped steel studs may be readily positioned into opposing U-shaped steel footer and header channel tracks (also sometimes referred to as runners) by means of retaining devices in one or both of the beams. Examples of such steel framed wall constructions may be found in U.S. Pat. Nos. 4,854,096 and 4,805,364 both to Smolik.

Steel framed wall constructions may also be configured to allow building movement such as during a seismic event without damage to the wallboard. In this regard, full-height non-load-bearing walls configured to accommodate vertical ceiling movement are known (e.g., dynamic head-of-wall systems), and are commonly installed beneath overhead structural members such as roof beams, floor beams, and the like. Examples of these types of steel framed wall constructions may be found in U.S. Pat. No. 5,127,203 to Paquette and U.S. Pat. No. 5,127,760 to Brady. In these exemplary steel framed wall assemblies a stud is vertically positioned within the U-shaped header track at a vertically aligned slot and a screw is inserted through the slot and into the stud. A wallboard is then attached to at least one side of the studs. In these type of configurations, and upon movement of the building and/or overhead structural member (e.g., during an earthquake), the studs are able to slide vertically in the header track as the screws slide in the slots (thereby preventing the wallboard from cracking by permitting up and down movement). In other words, and because the studs and wallboard are spaced apart from the ceiling a short gap distance, ceiling deflections caused by seismic activity or moving overhead loads can be readily accommodated.

A disadvantage of these prior art approaches, however, is that each screw must be precisely installed by a tradesman standing on a stool or ladder, which is both time-consuming and expensive. The fastening screw must not be installed too tight such that it could bind and prevent the sliding motion of the stud within the track. The screw must also not be installed too loose such that it protrudes and inhibits subsequent wallboard installation. U.S. Pat. No. 6,748,705 to Orszulak et al. overcomes these shortcomings by providing an M-shaped header receiving track that includes a plurality of longitudinally spaced apart elongated retaining slots, with each slot being sized and configured to receive an upper end portion of a steel stud. In this fastener-less configuration, the studs are able to slide vertically within the retaining slots of the M-shaped header.

A common problem associated with all of the above-identified steel framed wall constructions is that they do not provide for a convenient and economical way for forming wallboard backing support along the inside corner formed at the intersection of two adjoining walls. As is appreciated by those skilled in the art, rigid backing support surfaces are needed adjacent to and along either side of such inside corner intersections (as well as other wall edges) so that wallboard (e.g., drywall or gypsum board) can be properly attached. In common practice and as shown in prior art FIGS. 3A-C, wallboard backing support at inside corner intersections is typically accomplished in the following exemplary manner: (1) a tradesman first vertically positions and secures a sheet metal stud (within the opposing footer and header U-shaped channel tracks) of a first wall immediately adjacent to the intersection of the first and second walls; (2) the same or different tradesman then attaches wallboard to the first wall (and generally in a manner such that a portion of the attached wallboard extends into the interior space of the second wall, with the wallboard being selectively notched to accommodate plumbing and/or electrical wiring that may have likely been installed); (3) the same or different tradesman then vertically positions and secures a second sheet metal stud of the second wall (commonly known as a "slip stud") immediately adjacent to the wallboard of the first wall, and (4) finally, the same or different tradesman then attaches additional wallboard to the second wall such that it abuts the wallboard of the first wall.

The above-described method for providing rigid backing support surfaces is inefficient both in terms of labor and materials. Therefore, there still exists a need in the art for novel structures and related methods for providing a rigid backing or support surface for wallboard at an inside corner formed at the intersection of two adjoining steel framed walls. The present invention fulfills these needs and provides for further related advantages.

SUMMARY OF THE INVENTION

In brief, the present invention is directed to an inside corner framing element for supporting wallboard. In one embodiment, the inside corner framing element is configured to vertically fit along an inside corner formed at the intersection of two adjoining walls, wherein each wall is of framed construction defined by generally confronting U-shaped sheet metal header and footer tracks having a plurality of a vertically positioned studs therebetween. The U-shaped sheet metal header and footer tracks have respective downwardly and upwardly extending side walls that retain the plurality of studs. In this embodiment, the inside corner framing element comprises an elongated sheet metal strip having an inner and outer surface, an upper and lower end, and at least two lengthwise interior bends. The at least two lengthwise interior bends are substantially parallel to each other and define (i) a first and second elongated web adjoined along a central web bend line, (ii) a central web angle between the inner surfaces of the first and second elongated web, with the central web angle being selected from an obtuse angle, a right angle, and an acute angle, (iii) a first elongated flange adjoined to the first elongated web along a first outer flange bend line, and (iv) a first outer flange angle between the outer surfaces of the first elongated flange and the first elongated web, with the first outer flange angle being selected from an obtuse angle, a right angle, and an acute angle. The inside corner framing element further comprises at least a first receiving slot for engaging the inside corner framing element to either a downwardly or upwardly directed side wall of the respective header and footer tracks. The first receiving slot may be positioned at either the upper end or the lower end of the elongated sheet metal strip.

In another embodiment, the inside corner framing element comprises an elongated sheet metal strip having an inner and outer surface, an upper and lower end, and at least three lengthwise interior bends. In this embodiment, the at least three lengthwise interior bends are substantially parallel to one another and define (i) a first and second elongated web adjoined along a central web bend line, (ii) a central web angle between the inner surfaces of the first and second elongated web, with the central web angle being selected from an obtuse angle, a right angle, and an acute angle, (iii) a first elongated flange adjoined to the first elongated web along a first outer flange bend line, and (iv) a first outer flange angle between the outer surfaces of the first elongated flange and the first elongated web, with the first outer flange angle being selected from an obtuse angle, a right angle, and an acute angle, (v) a second elongated flange adjoined to the second elongated web along a second outer flange bend line, and (vi) a second outer flange angle between the outer surfaces of the second elongated flange and the second elongated web, with the second outer flange angle being selected from an obtuse angle, a right angle, and an acute angle. The inside corner framing element further comprises at least a first linear receiving slot for engaging the inside corner framing element to either a downwardly or upwardly directed side wall of the respective header and footer tracks. The first linear receiving slot may be positioned along the first bend line at the upper end of the elongated sheet metal strip. The inside corner framing element also further comprises a second linear receiving slot for engaging the inside corner framing element to either a downwardly or upwardly directed side wall of the respective header and footer tracks. The second linear receiving slot may be positioned along the first bend line at the lower end of the elongated sheet metal strip. Alternatively, the second linear receiving slot may be positioned along the second bend line at the upper end of the elongated sheet metal strip.

In yet another embodiment, the present invention is directed to an inside corner framing element for supporting wallboard, comprising: an elongated sheet metal strip bent lengthwise two times to define a truncated W-shaped cross-sectional profile; and at least one linear receiving slot positioned at an end of the elongated sheet metal strip.

In yet still another embodiment, the present invention is directed to an inside corner framing element for supporting wallboard, comprising: an elongated sheet metal strip bent lengthwise three times to define a W-shaped cross-sectional profile; and at least one linear receiving slot positioned at an end of the elongated sheet metal strip.

Finally, and in another aspect, the present invention is directed to methods of making an inside corner framing element for supporting wallboard, as well as to the inside corner framing elements made therefrom. The method in one embodiment comprises at least the steps of: providing an elongated sheet metal strip; forming a first linear receiving slot along a first lengthwise outer flange bend line and at an end of the sheet metal strip; bending the sheet metal strip along the first lengthwise outer bend line to define a first flange and a first outer flange angle; and bending the sheet metal strip along a central bend line to define a first and second elongated web adjoined along a central angle.

These and other aspects of the present invention will become more evident upon reference to the following detailed description and attached drawings. It is to be understood, however, that various changes, alterations, and substitutions may be made to the specific embodiments disclosed herein without departing from their essential spirit and scope. Finally, it is expressly provided that all of the various references cited herein are incorporated herein by reference in their entireties for all purposes.

BRIEF DESCRIPTION OF THE DRAWINGS

The drawings are intended to be illustrative and symbolic representations of certain exemplary embodiments of the present invention and as such they are not necessarily drawn to scale. In addition, and for purposes of clarity, like reference numerals have been used to designate like features throughout the several views of the drawings.

DETAILED DESCRIPTION OF THE INVENTION

Figure 1:
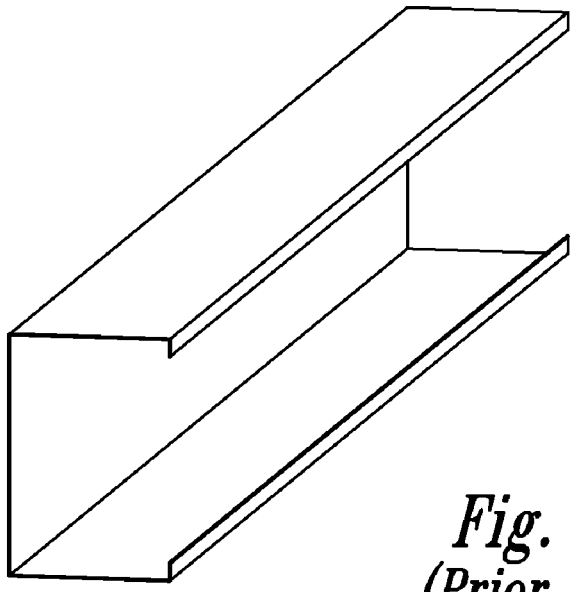
Fig. 1 (Prior Art)
FIG. 1 illustrates a perspective view of a prior art "C"-shaped steel stud.
Figure 2:
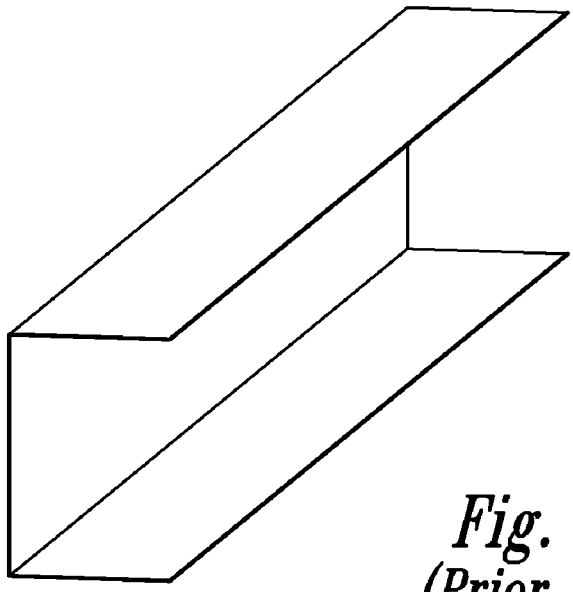
Fig. 2 (Prior Art)
FIG. 2 illustrates a perspective view of a prior art "U"-shaped steel track.
Figure 3A:
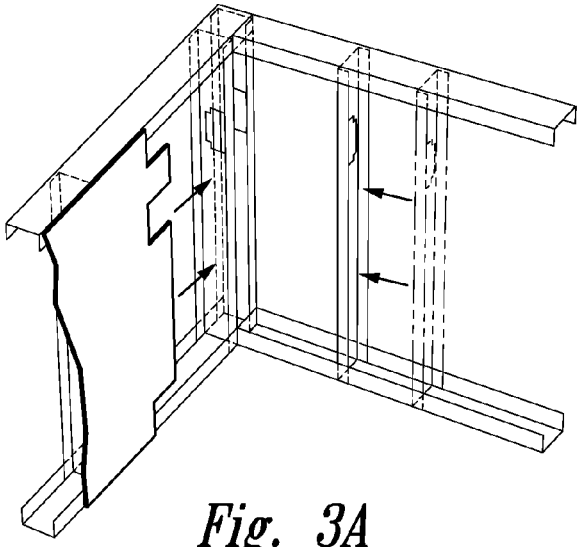
Fig. 3A (Prior Art)
FIG. 3A illustrates a perspective sectional view of a prior art sheet metal framing and wallboard assembly having a first rigid backing support surface along a first wall and at the intersection of two adjoining walls (i.e., at the intersection of the first wall and a second wall), wherein the first rigid backing surface is formed by vertical placement of a first sheet metal stud, and wherein the wallboard is being moved (as shown by arrows) into position along the first wall.
Figure 3B:
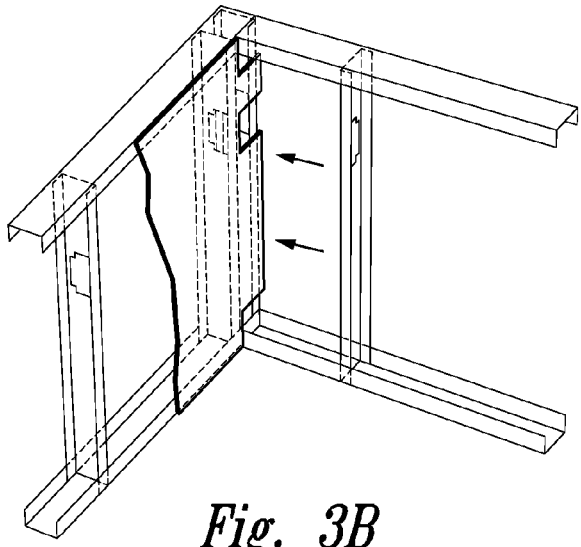
Fig. 3B (Prior Art)
FIG. 3B illustrates a perspective sectional view of a prior art sheet metal framing and wallboard assembly of 3A, wherein the wallboard has been positioned on the first wall, and wherein a "slip stud" is being moved (as shown by arrows) into position immediately adjacent to the wallboard of the first wall.
Figure 3C:
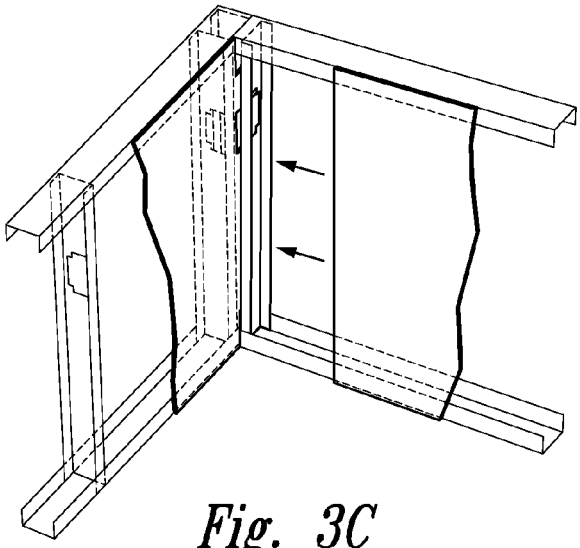
Fig. 3C (Prior Art)
FIG. 3C illustrates a perspective sectional view of the prior art sheet metal framing and wallboard assembly of FIGS. 3A-B, wherein the wallboard is being moved (as shown by arrows) into position along the second wall.
Figure 4A:
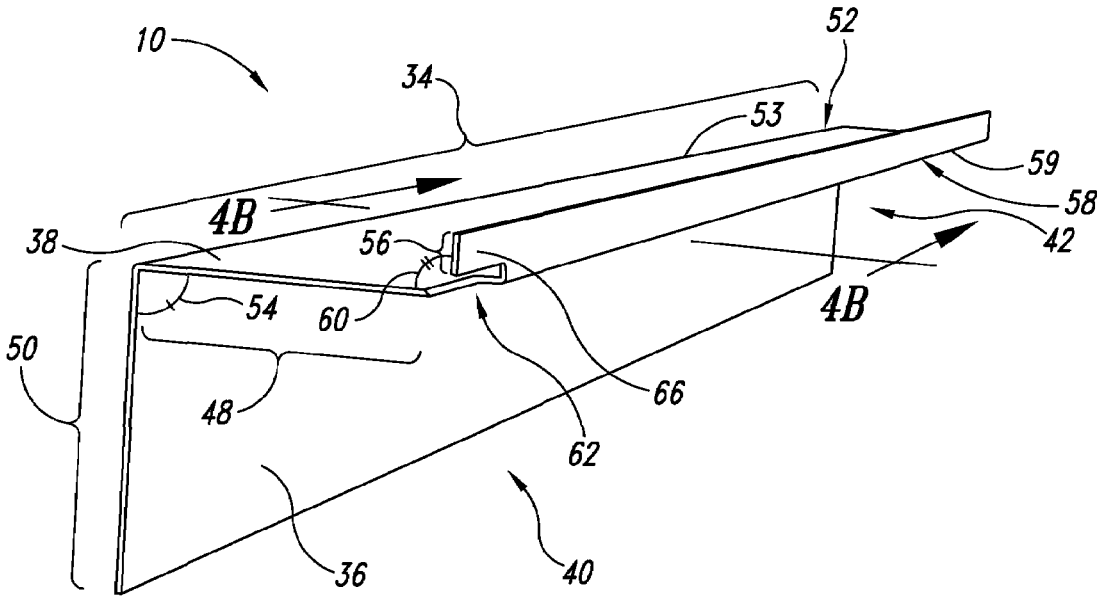
FIG. 4A illustrates a perspective view of an inside corner framing element having two lengthwise bends and a first receiving slot located at an upper end in accordance with a first embodiment of the present invention.
Figure 4B:
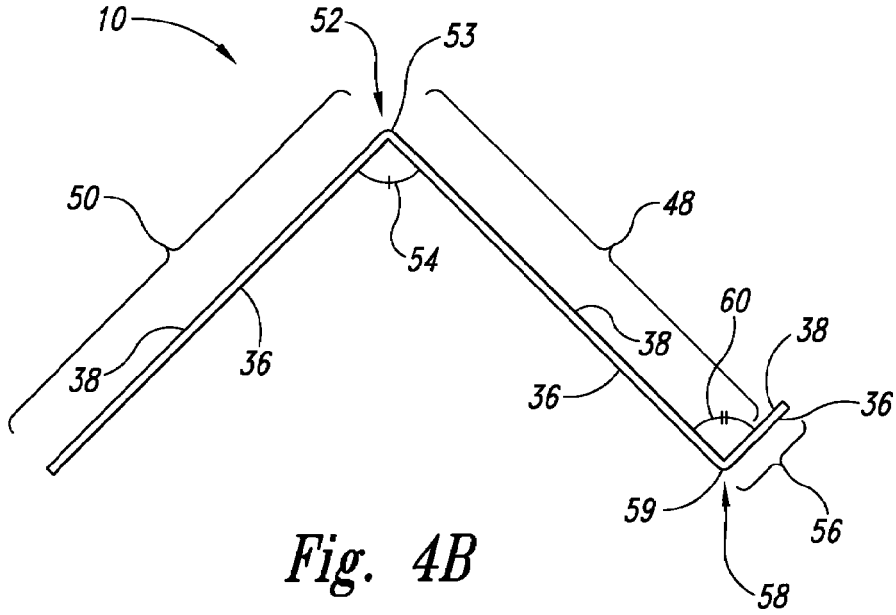
FIG. 4B illustrates a cross-sectional view of the inside corner framing element of FIG. 4A taken along line 4B-4B.
Figure 5A:
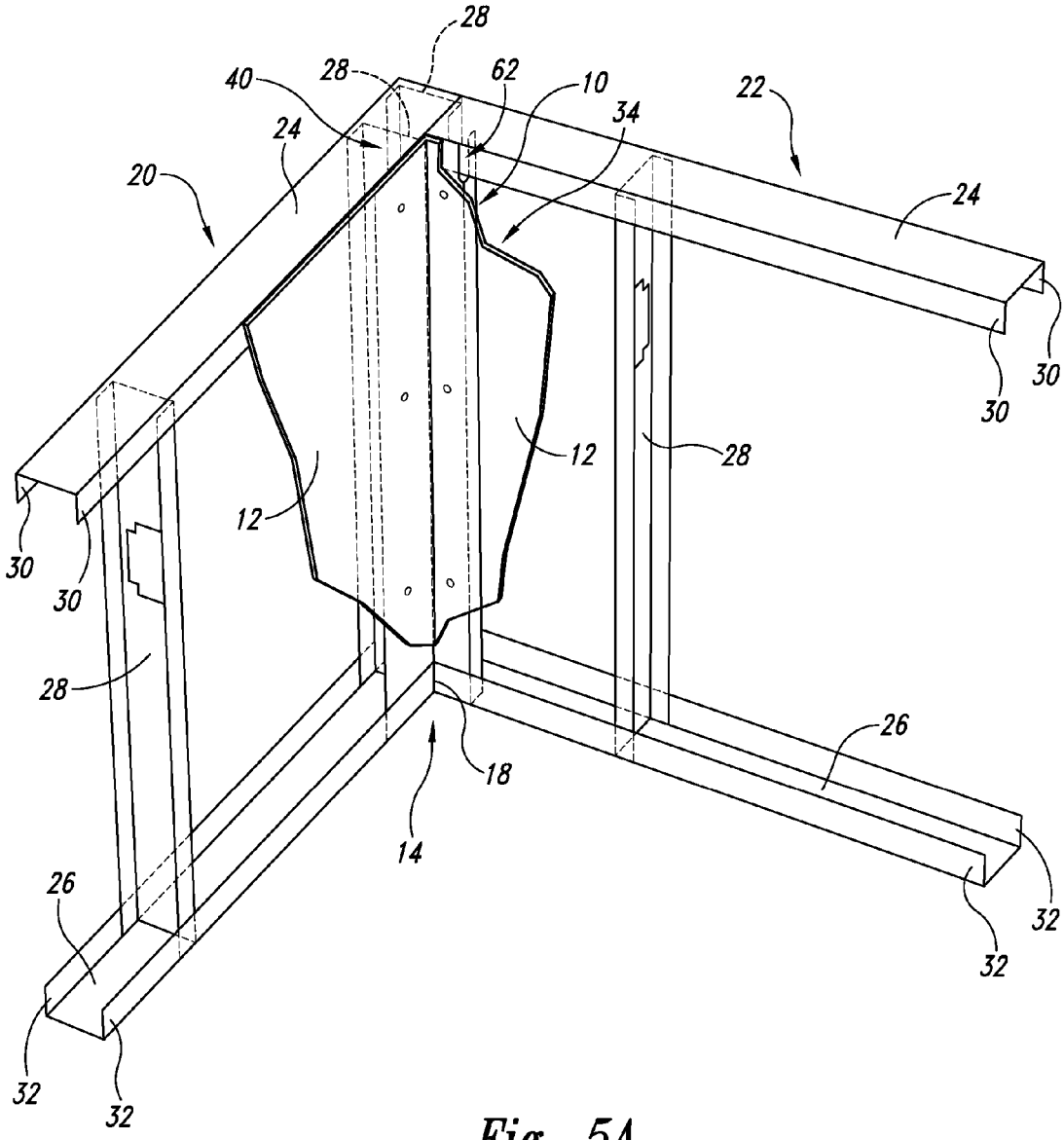
FIG. 5A illustrates a perspective sectional view of an inside corner framing element in accordance with the first embodiment (shown in FIGS. 4A-B) and shows the inside corner framing element vertically positioned along an inside corner formed at the intersection of two adjoining walls, with each wall being of framed construction defined by generally confronting U-shaped sheet metal header and footer tracks having a plurality of a vertically positioned studs therebetween.
Figure 5B:
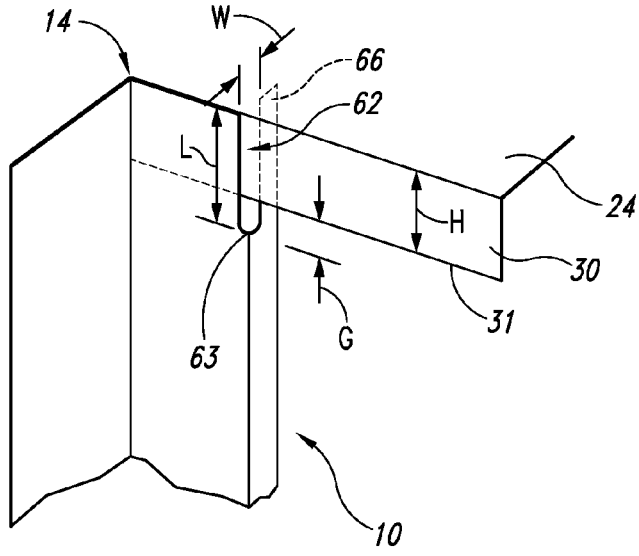
FIG. 5B illustrates an enlarged view of an upper end portion of the inside corner framing element of FIG. 5A and shows the first receiving slot being engaged with a downwardly extending sidewall of the U-shaped header.
Figure 5C:
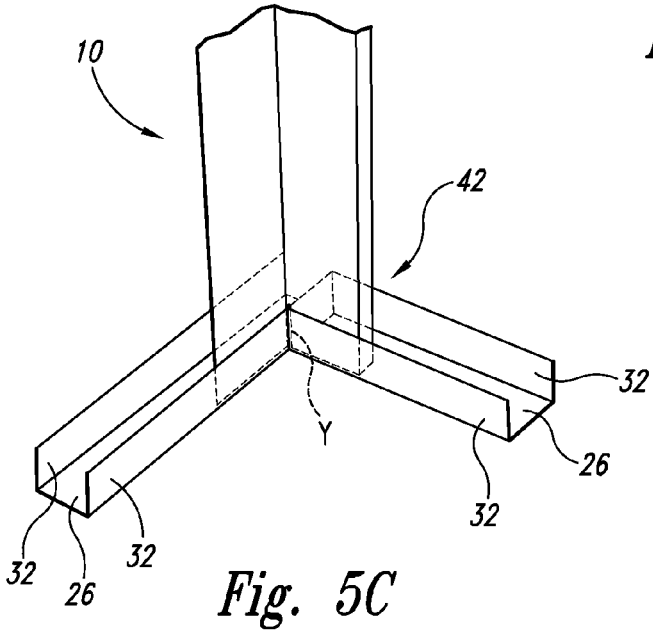
FIG. 5C illustrates an enlarged view of a lower end portion of the inside corner framing element of FIG. 5A and shows the inside corner framing element being positioned within and immediately adjacent to upwardly extending side walls of the U-shaped footer tracks.
Figure 5D:
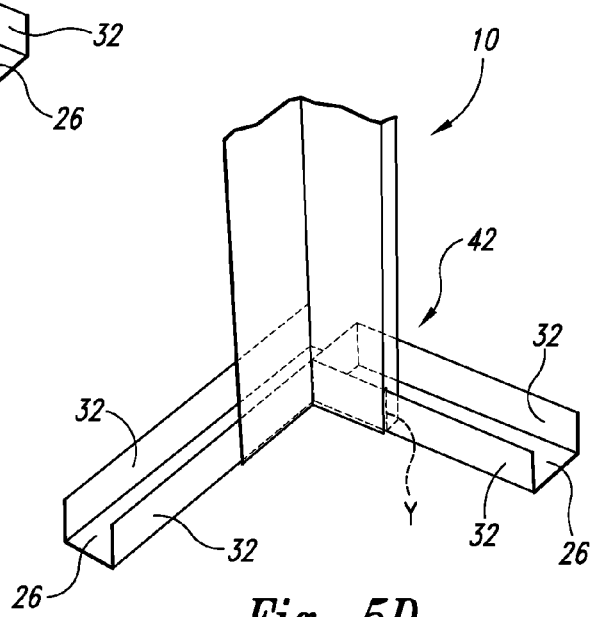
FIG. 5D illustrates an enlarged view of a lower end portion of the inside corner framing element of FIG. 5A and shows the inside corner framing element being positioned substantially exterior and immediately adjacent to upwardly extending side walls of the U-shaped footer tracks.
Figure 6:
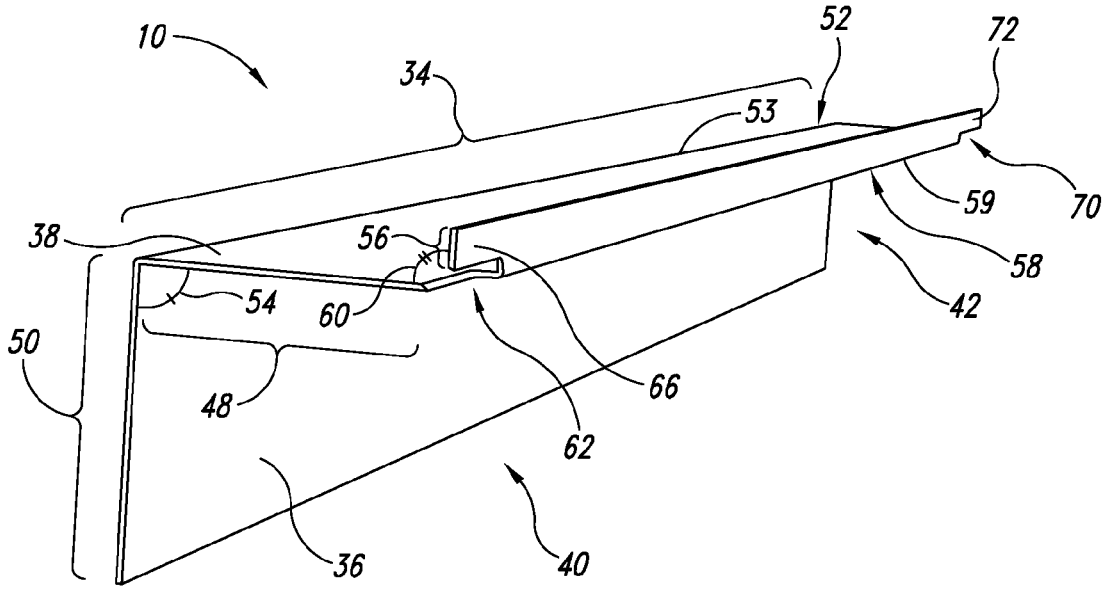
FIG. 6 illustrates a perspective view of an inside corner framing element having two lengthwise bends and first and second receiving slots located at respective upper and lower ends in accordance with a second embodiment of the present invention.
Figure 7A:
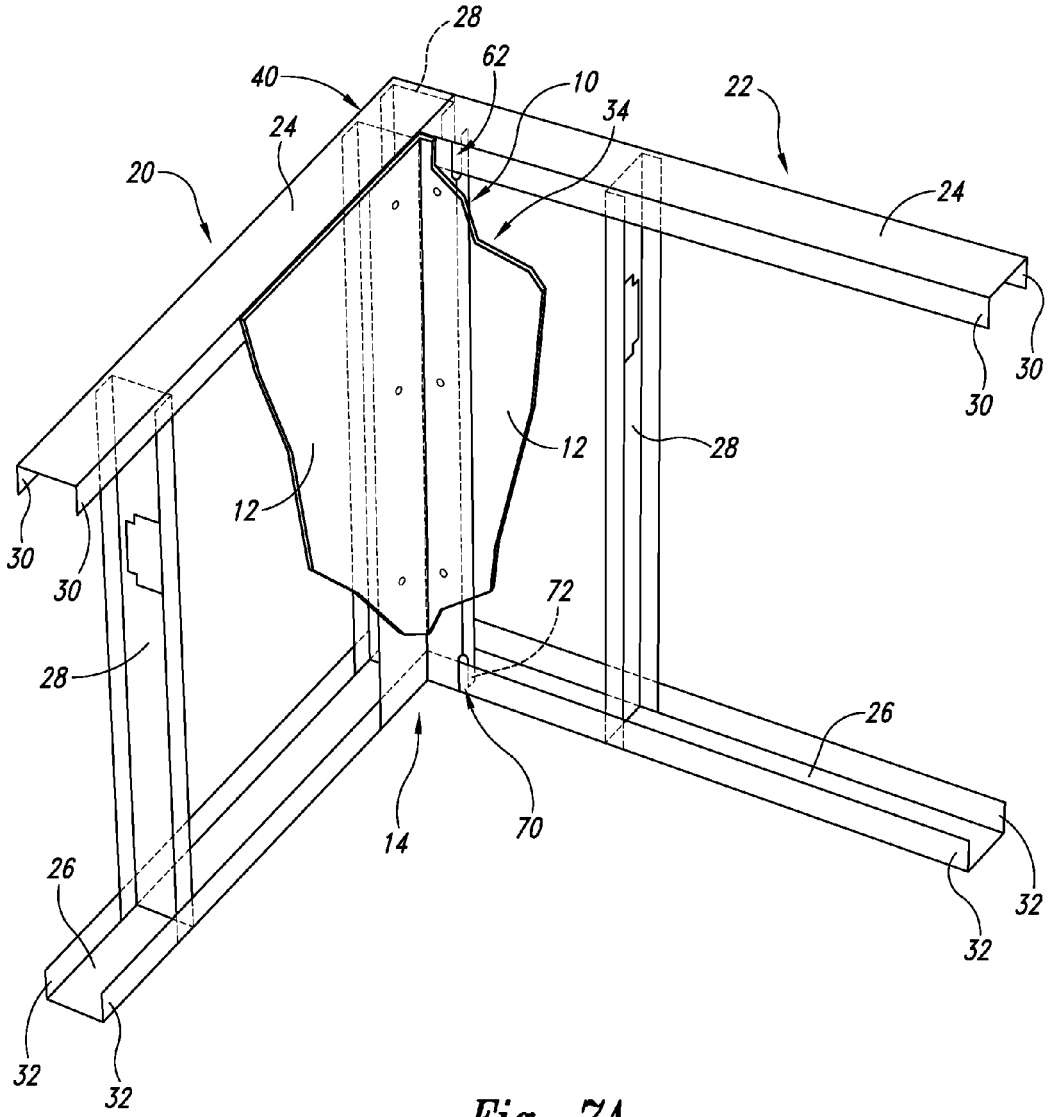
FIG. 7A illustrates a perspective sectional view of an inside corner framing element in accordance with the second embodiment (shown in FIG. 6) and shows the inside corner framing element vertically positioned along an inside corner formed at the intersection of two adjoining walls, with each wall being of framed construction defined by generally confronting U-shaped sheet metal header and footer tracks having a plurality of a vertically positioned studs therebetween.

Referring now to the drawings wherein like reference numerals designate identical or corresponding elements, and more particularly to FIGS. 4A-B and 5A-D (first embodiment), and FIGS. 6 and 7A-C (second embodiment), the present invention in first and second embodiments is directed to an inside corner framing element 10 for supporting wallboard 12. The inside corner framing elements 10 associated with these first two embodiments are configured to vertically fit along an inside corner 14 formed at the intersection 18 of two adjoining walls 20, 22. As best shown in FIGS. 5A and 7A, each wall 20, 22 is of framed construction defined by generally confronting U-shaped sheet metal header and footer tracks 24, 26 having a plurality of vertically positioned studs 28 therebetween. The U-shaped sheet metal header and footer tracks 24, 26 have respective downwardly and upwardly extending side walls 30, 32 that retain the plurality of studs 28.

As best shown in FIGS. 4A-B and FIG. 6, the inside corner framing elements 10 (associated with the first and second embodiments) each comprise an elongated sheet metal strip 34 having an inner and outer surface 36, 38, an upper and lower end 40, 42, and at least two lengthwise interior bends 52, 58. The elongated sheet metal strip 34 is generally of a selected length (e.g., 8 ft, 10 ft, 12 ft, 14 ft, 16 ft, et cetera, length spans that may be subsequently cut to fit) that nearly corresponds to the height of the two adjoining walls 20, 22 shown in FIG. 5A and FIG. 7A. As best shown in FIG. 4A-B and FIG. 6, the at least two lengthwise interior bends 52, 58 are substantially parallel to each other and define (i) a first and second elongated web 48, 50 adjoined along a central web bend line 53, (ii) a central web angle 54 between the inner surfaces 36 of the first and second elongated web 48, 50 (with the central web angle 54 being either an obtuse angle, a right angle, or an acute angle depending on the orientation of the adjoining walls 20, 22 relative to each other), (iii) a first elongated flange 56 adjoined to the first elongated web 48 along a first outer flange bend line 59, and (iv) a first outer flange angle 60 between the outer surfaces 38 of the first elongated flange 56 and the first elongated web 48 (with the first outer flange angle 60 being either an obtuse angle, a right angle, or an acute angle depending on the orientation of the adjoining walls 20, 22 relative to each other). Note: when the adjoining walls 20, 22 are perpendicularly oriented with respect to each other, as is most common in the building construction trade, both the central web angle 54 and the first outer flange angle 60 are preferably right angles.

Figure 7B:
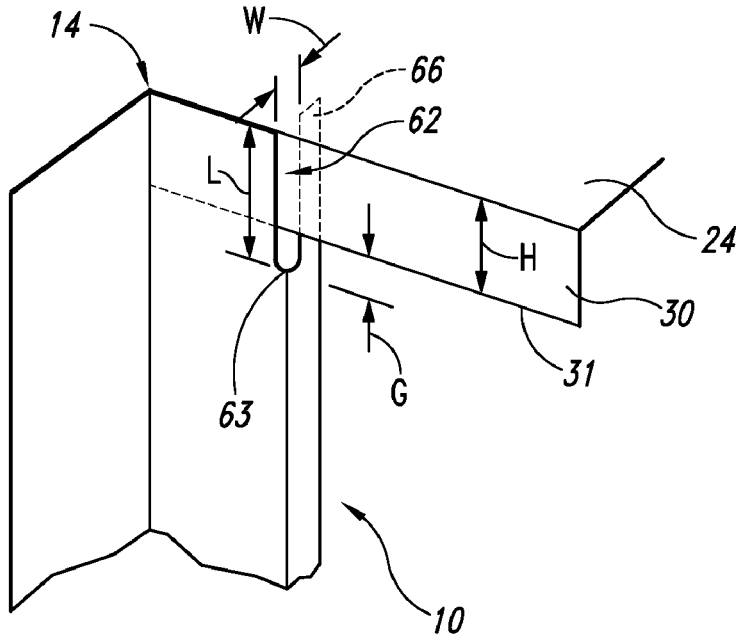
FIG. 7B illustrates an enlarged view of an upper end portion of the inside corner framing element of FIG. 7A and shows the first receiving slot being engaged with a downwardly extending sidewall of the U-shaped header.
Figure 7C:
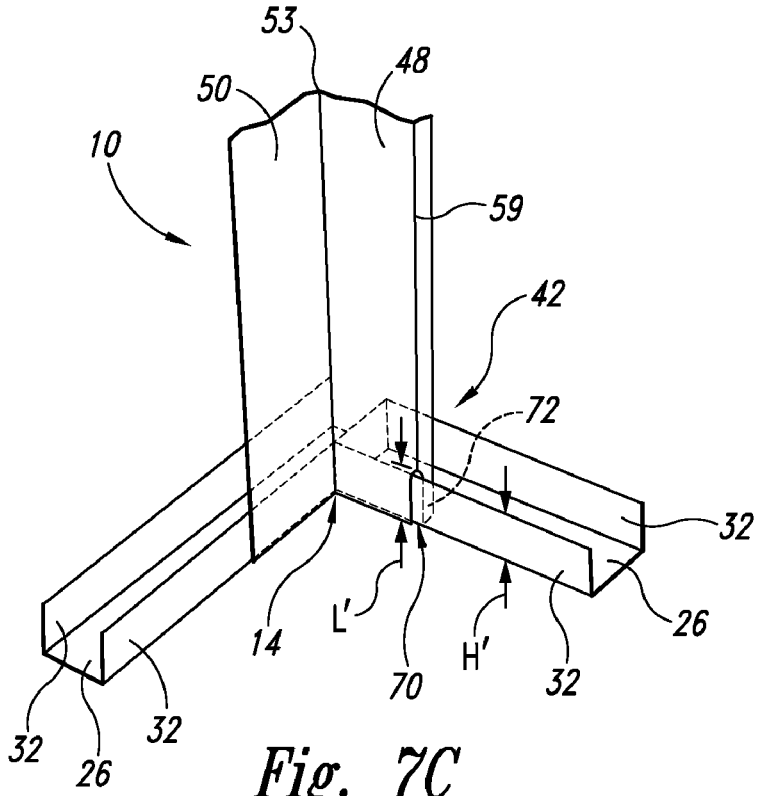
FIG. 7C illustrates an enlarged view of a lower end portion of the inside corner framing element of FIG. 7A and shows the second receiving slot being engaged with an upwardly extending sidewall of the U-shaped footer.

As best shown in FIGS. 4A and 5A and FIGS. 6 and 7A, the elongated sheet metal strips 34 (associated with the first and second embodiments) each further comprise a first receiving slot 62 located at the upper end 40 for engaging the inside corner framing element 10 to a downwardly directed side wall 30 of the header track 24. As best shown in FIGS. 6 and 7C, the elongated sheet metal strip 34 of the second embodiment also includes a second receiving slot 70 located at the lower end 42 for engaging the inside corner framing element 10 to an upwardly directed side wall 32 of the footer track 26. The first and second receiving slots 62, 70 (associated with the first embodiment, and the first and second embodiments, respectively) are preferably linear and longitudinally positioned along the first outer flange bend line 59; they may, however, in alternative embodiments be positioned on the first web 48, the central web bend line 53, or the second web 50. As best shown in FIG. 5B and FIGS. 7B-C, the first and second receiving slots 62, 70 are also preferably (but not necessarily) open-ended, meaning that they define respective bendable upper and lower first tab portions 66, 72 that facilitate engagement of the inside corner framing element 10 to the respective downwardly and upwardly extending side walls 30, 32 of the U-shaped sheet metal header and footer tracks 24, 26. In other words, the inside corner framing element 10, when vertically positioned at the inside corner 14, straddles the respective upwardly and downwardly extending side walls (of the generally confronting U-shaped sheet metal header and footer tracks 24, 26) by way of the first and second receiving slots 62, 70 (associated with the first embodiment, and the first and second embodiments, respectively), and such straddling (i.e., engagement) is facilitated due to the bendability of the upper and lower first tab portions 66, 72.

Figure 5E:
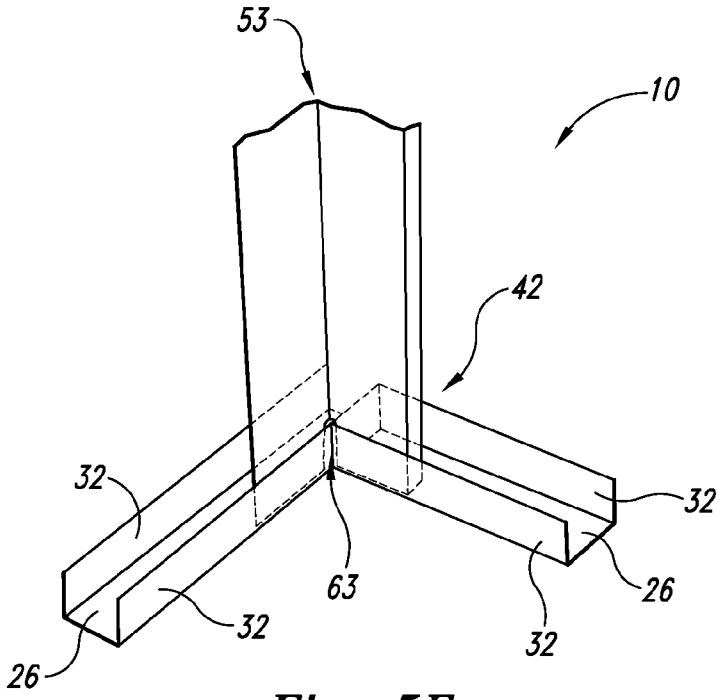
FIG. 5E illustrates an enlarged view of a lower end portion of an inside corner framing element similar to those shown in FIGS. 5C-D, but wherein an additional slot has been added along a center bend and at a lower end.

Alternately, and as is shown in FIG. 5E, the first embodiment may also include a center receiving slot 63 located on the lower end 42 of the framing element 10 and along the central bend line 53, allowing the lower end 42 of the inside corner framing element 10 to engage with the footer tracks 26 and eliminating the need for a tradesman to manually cut a receiving slit Y.

In certain preferred embodiments and as best shown in FIG. 5B and FIG. 7B, the first receiving slot 62 has a width W of about ⅜ inch, a length L that is sufficient to define a gap G between the lower edge 31 of the downwardly extending side wall 32 of the header track 24 and the low point 63 of the first receiving slot 62. More specifically, the length L of the first receiving slot 62 is preferably at least about a ½ inch greater than the height H of the downwardly extending sidewall 30 (of the U-shaped sheet metal header track 24) that it engages, thereby defining the gap G to be about ½ inch in height (as measured from the lower edge 31 to the low point 63). Similarly, the length L' of the second receiving slot 70 (associated with the second embodiment and as shown in FIG. 7C) is preferably at least the same as the height H' of the upwardly extending sidewall 32 (of the U-shaped sheet metal footer track 26) that it engages. In these configurations, ceiling deflections caused by seismic activity or moving overhead loads, for example, can be readily accommodated.

In addition to the presence of the second receiving slot 70 (second embodiment only), and as best shown in FIG. 5C-D and FIG. 7C, the inside corner framing elements 10 associated with the first and second embodiments also differ in the way that each is engaged or connected to the footer tracks 26 of the two adjoining walls 20, 22. More specifically, and because the first embodiment lacks the presence of any lower end receiving slot(s), the inside corner framing element 10 associated with the first embodiment is either (1) positioned within and immediately adjacent to the respective upwardly extending side walls 32 of the footer tracks 26 (as shown in FIG. 5C), or (2) positioned substantially exterior and immediately adjacent to the respective upwardly extending side walls 32 of the footer tracks 26 (as shown in FIG. 5D). In either case and as shown, the footer track (or inside corner framing element 10) must generally first be cut (by a tradesman utilizing a metal cutter, for example) along vertically oriented cut lines (not shown) so as to form footer track receiving slits Y that, in turn, engage the lower end 42 of the inside corner framing element 10. (Alternatively, the tradesman could cut the lower end 42 of the inside corner framing element 10 so as to forming receiving slits (not shown) along the lower end 42 of the inside corner framing element 10.)

As shown in FIGS. 4A-B and FIG. 6, the inside corner framing elements 10 associated with the first and second embodiments of the present invention both define a truncated W-shaped cross-sectional profile (best shown in FIG. 4B). As used herein, the term "truncated W-shaped cross-sectional profile" means a shape that is substantially the same as the shape shown in FIG. 4B.

Referring now to FIGS. 8A-B and 9A-C (third embodiment), and FIGS. 10 and 11A-C (fourth embodiment), the present invention in third and fourth embodiments is directed to an inside corner framing element 10 in which the elongated sheet metal strip 34 further comprises a third lengthwise interior bend 74 that, in turn, is substantially parallel to the at least two lengthwise interior bends 52, 58. In these further third and fourth embodiments, the third lengthwise interior bend 74 defines (v) a second elongated flange 76 adjoined to the second elongated web 50 along a second outer flange bend line 78, and (vi) a second outer flange angle 80 between the outer surfaces 38 of the second elongated flange 76 and the second elongated web 50 (with the second outer flange angle 80 being either an obtuse angle, a right angle, or an acute angle depending on the orientation of the adjoining walls 20, 22 relative to each other). Note: when the adjoining walls 20, 22 are perpendicularly oriented with respect to each other as is most common in the building construction trade, the central web angle 54, the first outer flange angle 60, and the second outer flange angle 80 are all preferably right angles.

Figure 8A:
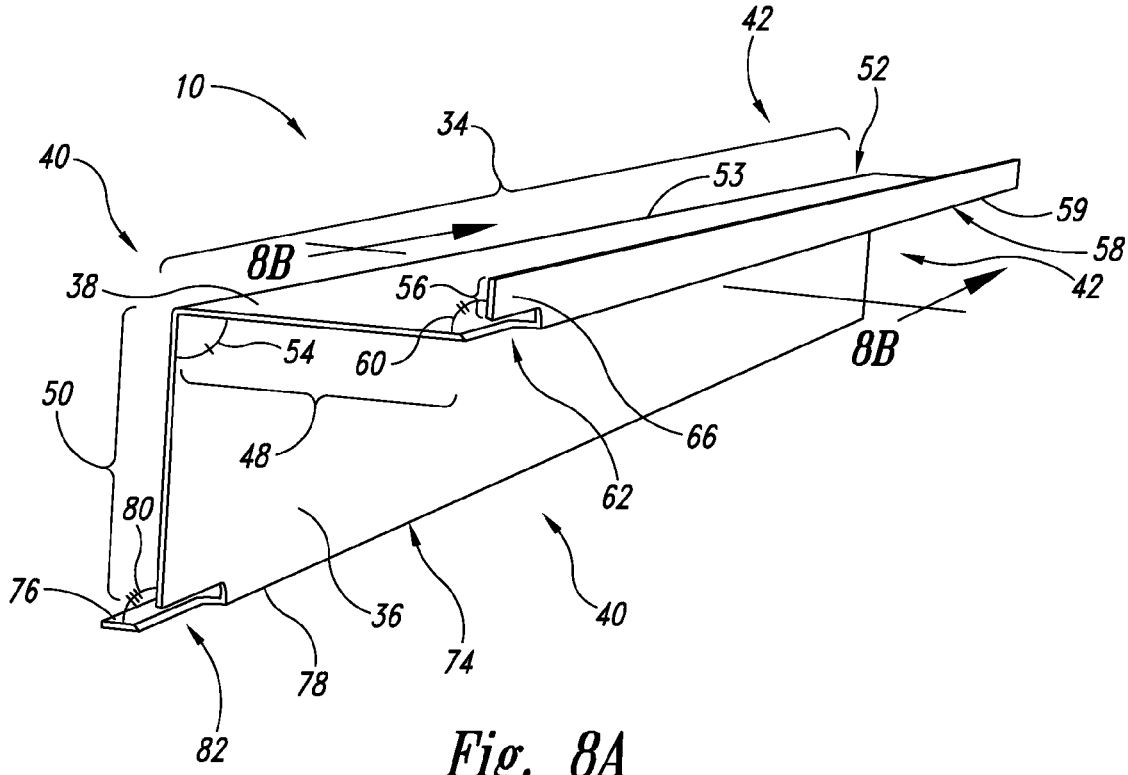
FIG. 8A illustrates a perspective view of an inside corner framing element having three lengthwise bends and a first and third receiving slot located at an upper end in accordance with a third embodiment of the present invention.
Figure 9A:
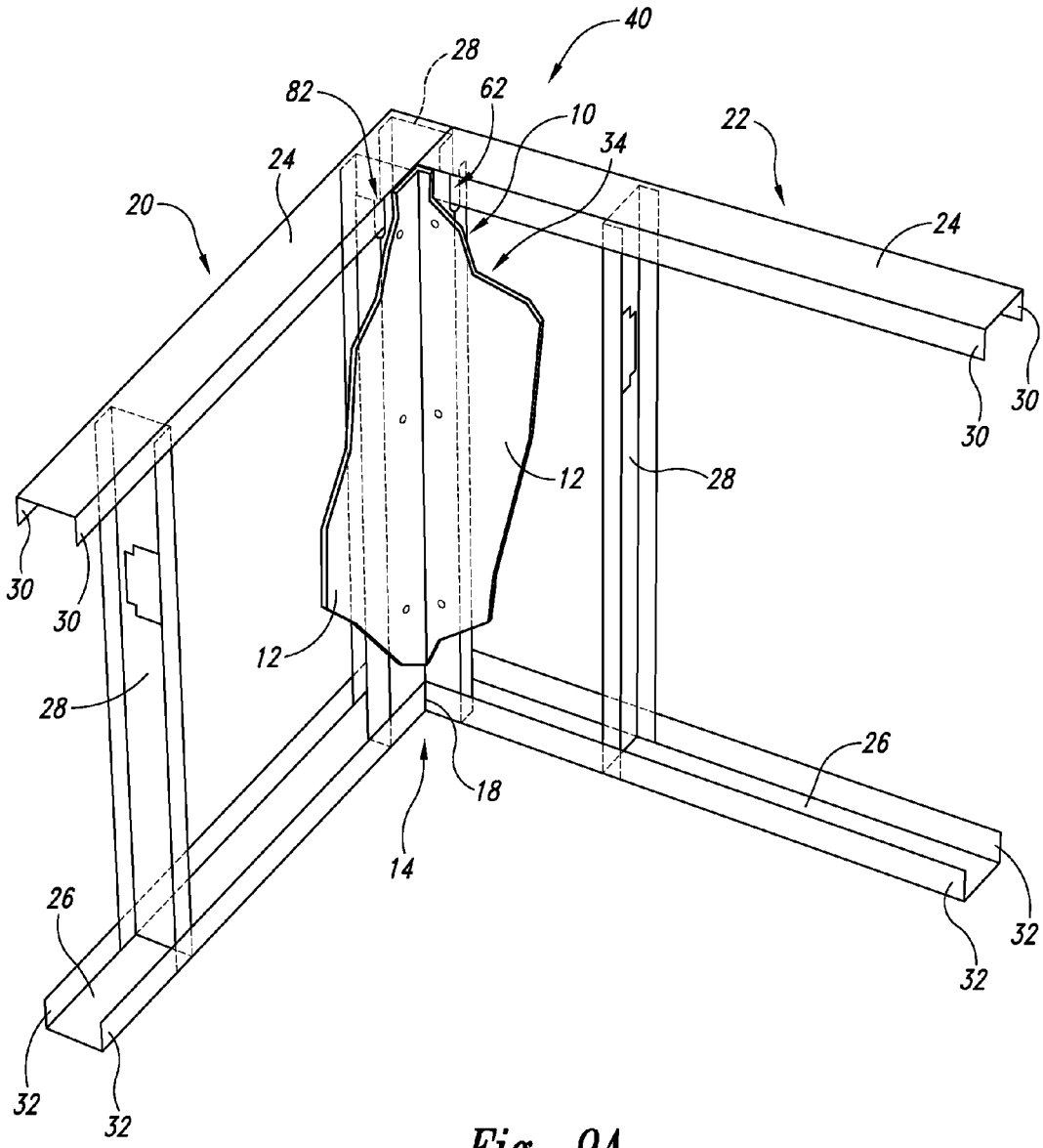
FIG. 9A illustrates a perspective sectional view of an inside corner framing element in accordance with the first embodiment (shown in FIGS. 8A-B) and shows the inside corner framing element vertically positioned along an inside corner formed at the intersection of two adjoining walls, with each wall being of framed construction defined by generally confronting U-shaped sheet metal header and footer tracks having a plurality of a vertically positioned studs therebetween.
Figure 9B:
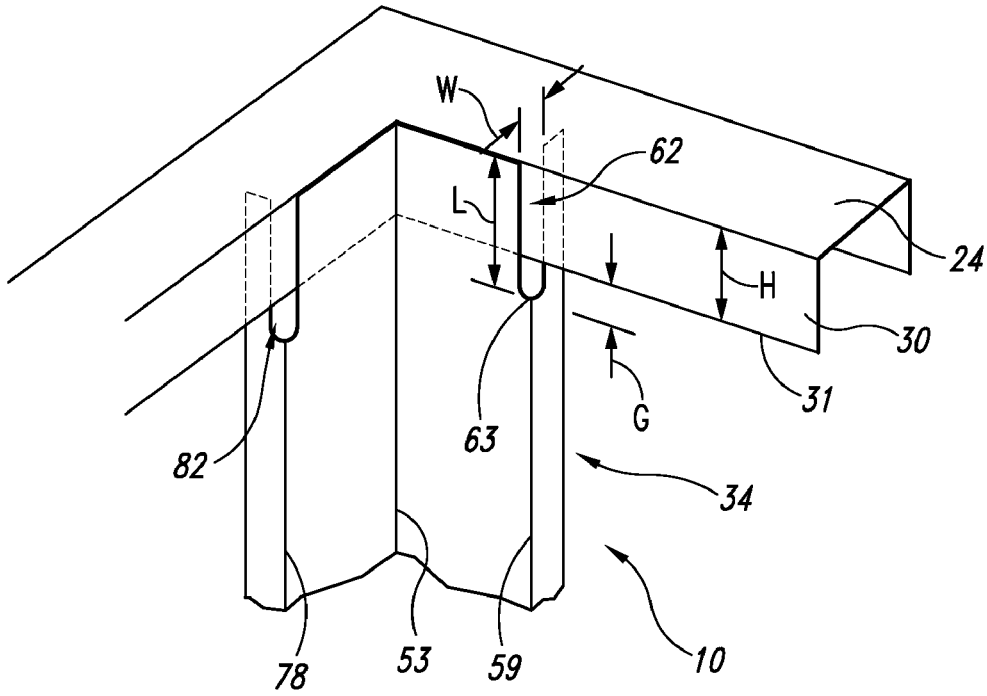
FIG. 9B illustrates an enlarged view of an upper end portion of the inside corner framing element of FIG. 9A and shows the first and third receiving slots being engaged with downwardly extending sidewalls of the U-shaped headers.
Figure 9C:
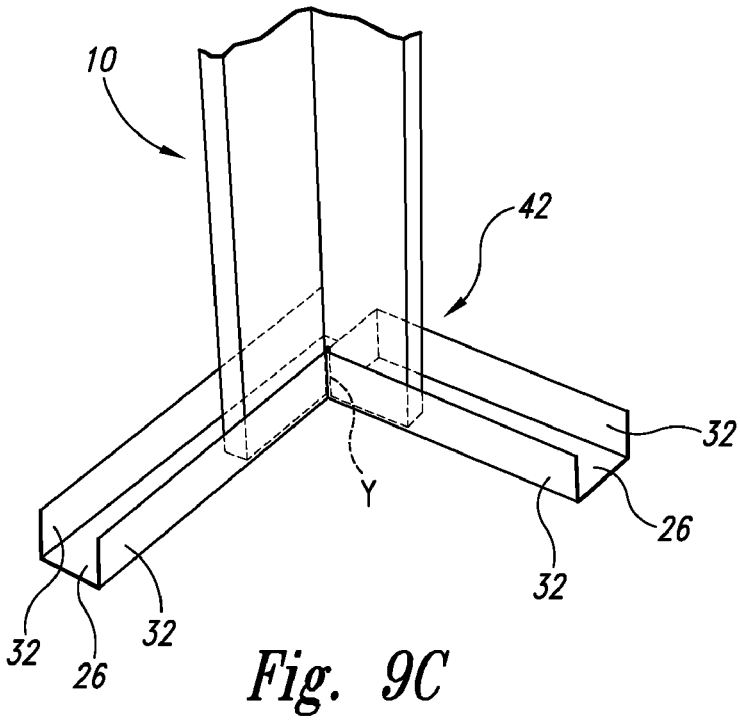
FIG. 9C illustrates an enlarged view of a lower end portion of the inside corner framing element of FIG. 9A and shows the inside corner framing element being positioned within and immediately adjacent to upwardly extending side walls of the U-shaped footer tracks.

As best shown in FIGS. 8A and 9B, the elongated sheet metal strip 34 (associated with the third embodiment) further comprises a third receiving slot 82 (i.e., a second slot designated as "a third receiving slot" for purposes of reference numeral consistency) located at the upper end 40 for engaging the inside corner framing element 10 to a downwardly directed side wall 30 of the header track 24. (Note: the inside corner framing element 10 associated with the third embodiment only includes two receiving slots designated, for purposes of reference numeral consistency (throughout the several views of the drawings), as a first receiving slot 62 and as a third receiving slot 82.)

Similarly, as shown in FIGS. 10 and 11A-C, the elongated sheet metal strip 34 (associated with the fourth embodiment) further comprises (i) a third receiving slot 82 located at the upper end 40 for engaging the inside corner framing element 10 to a downwardly directed side wall 30 of the header track 24, and (ii) a fourth receiving slot 86 located at the lower end 42 for engaging the inside corner framing element 10 to an upwardly directed side wall 32 of the footer track 26. Like the first and second receiving slots 62, 70, the third and fourth receiving slots 82, 86 are both preferably linear and longitudinally positioned along the second outer flange bend line 78; they may, however, in alternative embodiments be positioned on the first web 48, the central web bend line 53, or the second web 50. In addition, and as shown, the dimensions of the third receiving slot 82 are preferably equivalent to the dimensions of the first receiving slot 62, and the dimensions of the fourth receiving slot 86 are preferably equivalent to the dimensions of the second receiving slot 70. In connection with the fourth embodiment (shown in FIGS. 10 and 11A-C), the first, second, third, and fourth receiving slots 62, 70, 82, 86 are all preferably equivalent in size to one another.

Figure 8B:
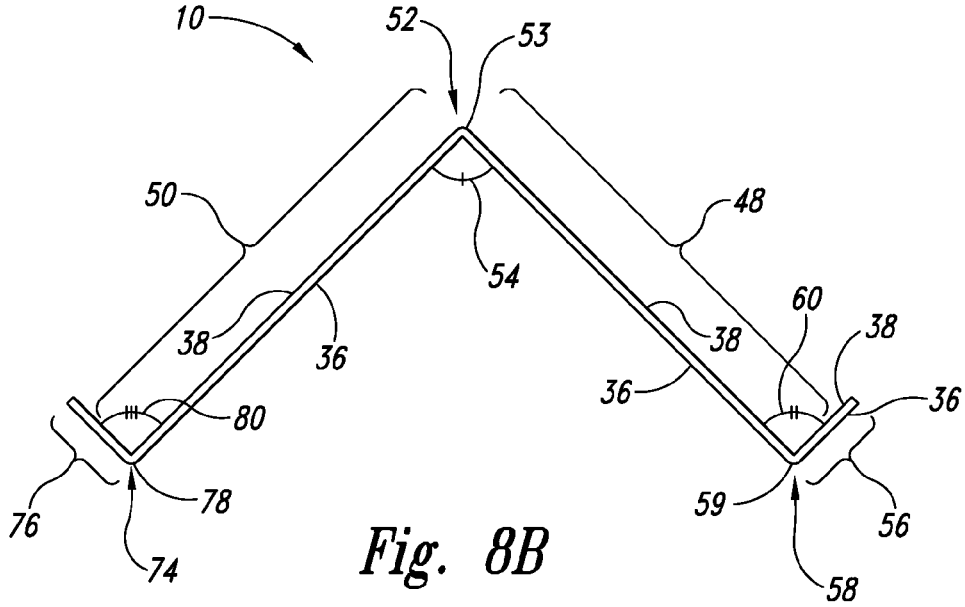
FIG. 8B illustrates a cross-sectional view of the inside corner framing element of FIG. 6A taken along line 8B-8B
Figure 10:
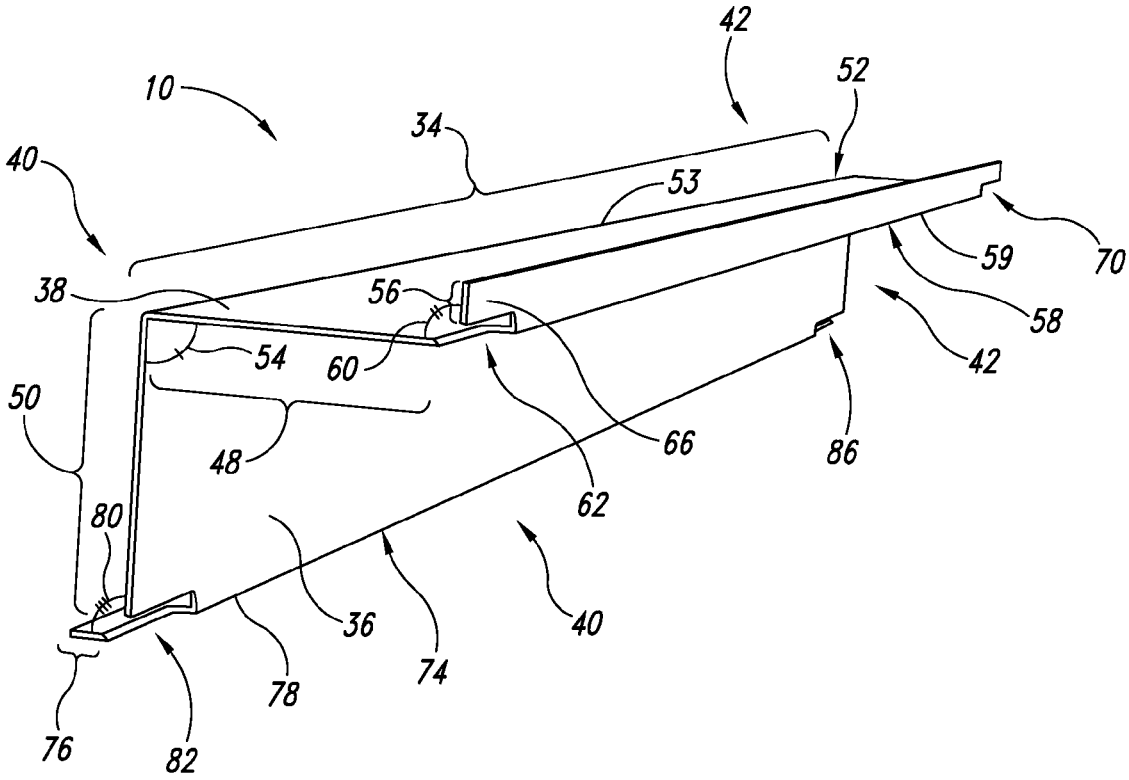
FIG. 10 illustrates a perspective view of an inside corner framing element having three lengthwise bends and first, second, third, and fourth receiving slots located at respective upper and lower ends in accordance with a fourth embodiment of the present invention.
Figure 11A:
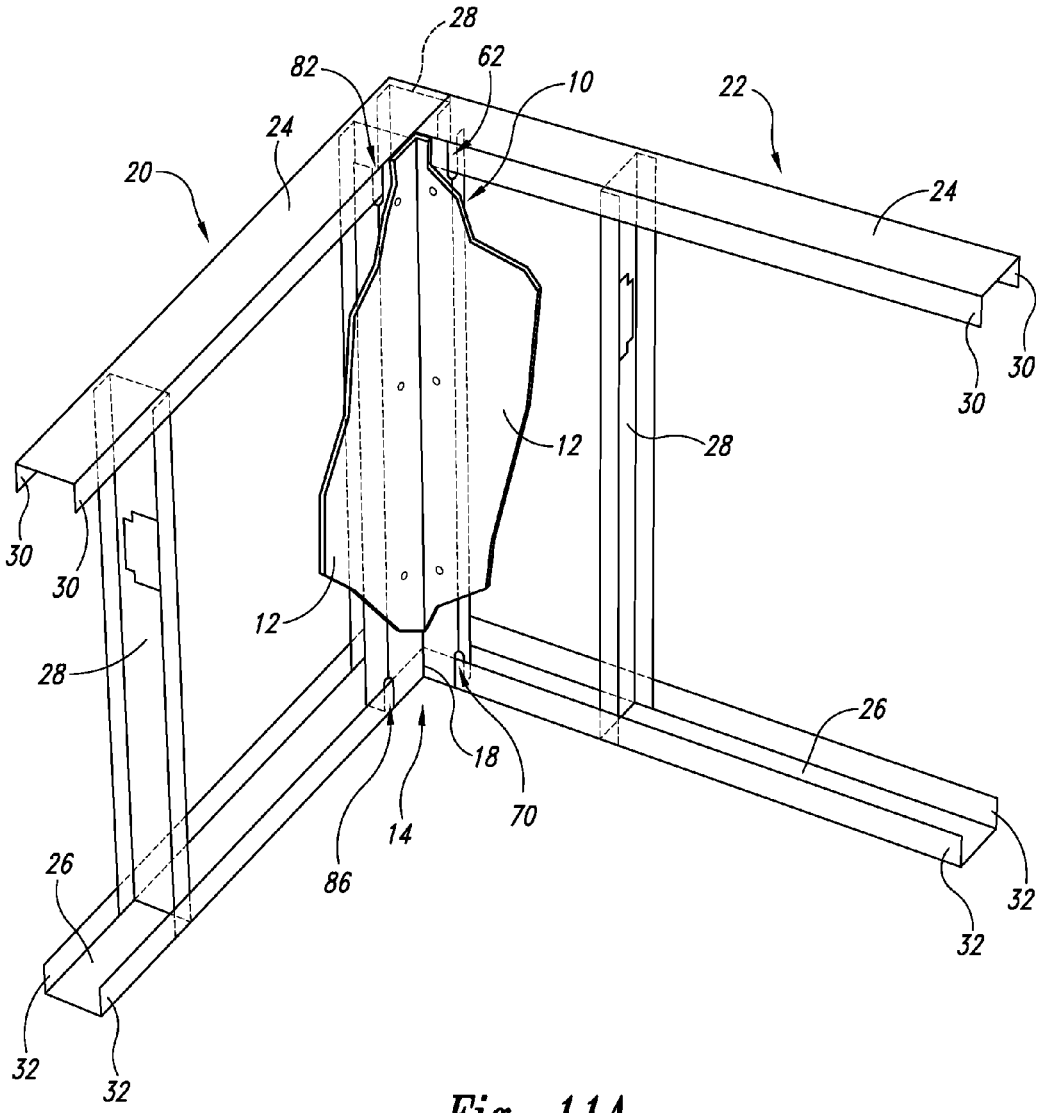
FIG. 11A illustrates a perspective sectional view of an inside corner framing element in accordance with the fourth embodiment (shown in FIG. 10) and shows the inside corner framing element vertically positioned along an inside corner formed at the intersection of two adjoining walls, with each wall being of framed construction defined by generally confronting U-shaped sheet metal header and footer tracks having a plurality of a vertically positioned studs therebetween.
Figure 11B:
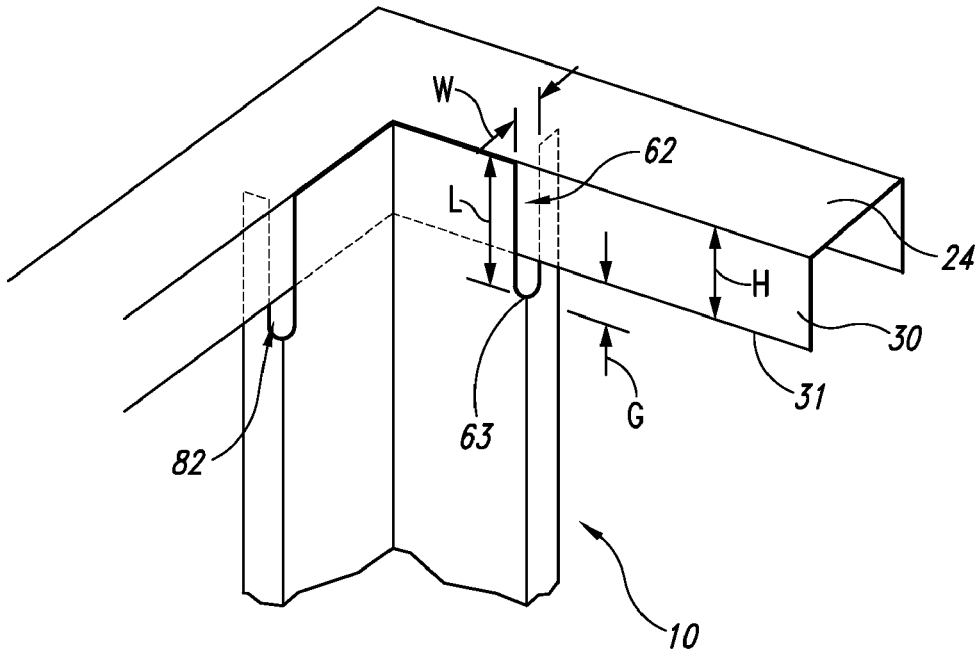
FIG. 11B illustrates an enlarged view of an upper end portion of the inside corner framing element of FIG. 11A and shows the first and third receiving slots being engaged with downwardly extending sidewalls of the U-shaped headers.
Figure 11C:
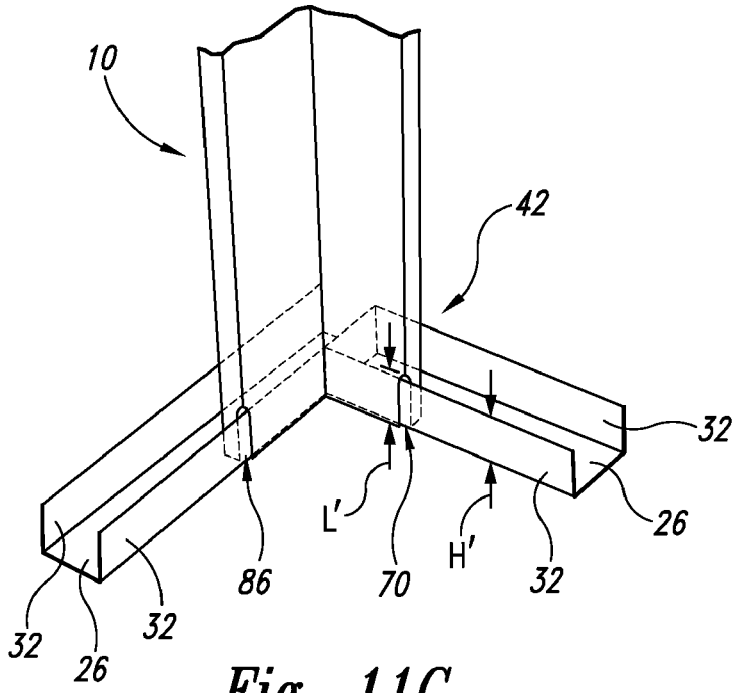
FIG. 11C illustrates an enlarged view of a lower end portion of the inside corner framing element of FIG. 11A and shows the second and fourth receiving slots being engaged with upwardly extending sidewalls of the U-shaped footers.

As shown in FIGS. 8A-B and FIG. 10, the inside corner framing elements 10 associated with the third and fourth embodiments of the present invention both define a W-shaped cross-sectional profile (best shown in FIG. 8B). As used herein, the term "W-shaped cross-sectional profile" means a shape that is substantially the same as the shape shown in FIG. 8B.

Figure 12:
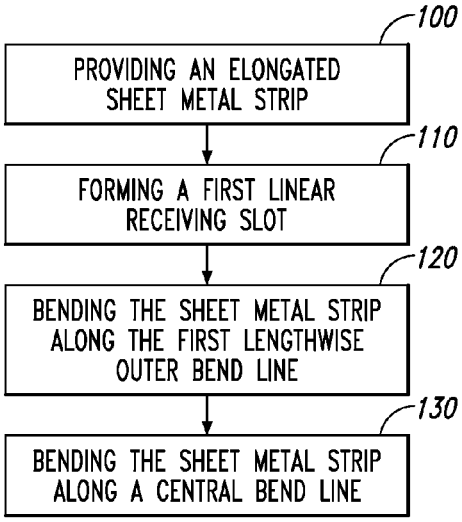
FIG. 12 depicts a process flow diagram associated with a method for making an inside corner framing element in accordance with the first embodiment of the present invention.

In addition to the foregoing, and in another aspect, the present invention is also directed to methods of making an inside corner framing element for supporting wallboard, as well as to the inside corner framing elements made therefrom. As depicted in FIG. 12, the method in one embodiment (corresponding to the structure of the first embodiment shown in FIGS. 4A-B and FIGS. 5A-D) comprises at least the steps of: providing an elongated sheet metal strip (step 100); forming a first linear receiving slot along a first lengthwise outer flange bend line and at an end of the sheet metal strip (step 110); bending the sheet metal strip along the first lengthwise outer bend line to define a first flange and a first outer flange angle (step 120); and bending the sheet metal strip along a central bend line to define a first and second elongated web adjoined along a central angle (step 130).

Figure 13:
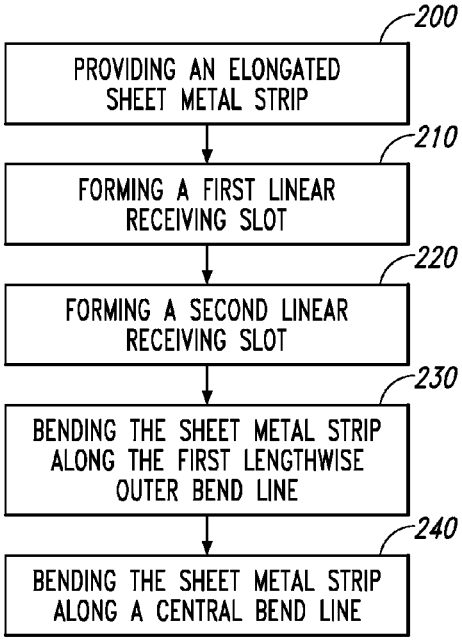
FIG. 13 depicts a process flow diagram associated with a method for making an inside corner framing element in accordance with the second embodiment of the present invention.

As depicted in FIG. 13, the method in another embodiment (corresponding to the structure of the second embodiment shown in FIGS. 6 and FIGS. 7A-C) comprises at least the steps of: providing an elongated sheet metal strip (step 200); forming a first linear receiving slot along a first lengthwise outer flange bend line and at an end of the sheet metal strip (step 210); forming a second linear receiving slot along the first lengthwise outer flange bend line and at an end of the sheet metal strip that is opposite the end that has the first receiving slot (step 220); bending the sheet metal strip along the first lengthwise outer bend line to define a first flange and a first outer flange angle (step 230); and bending the sheet metal strip along a central bend line to define a first and second elongated web adjoined along a central angle (step 240).

Figure 14:
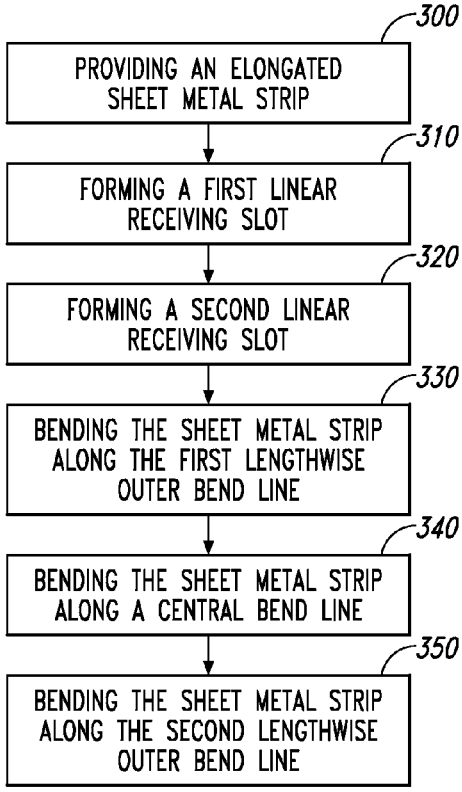
FIG. 14 depicts a process flow diagram associated with a method for making an inside corner framing element in accordance with the third embodiment of the present invention.

As depicted in FIG. 14, the method in yet another embodiment (corresponding to the structure of the third embodiment shown in FIGS. 8A-B and FIGS. 9A-C) comprises at least the steps of: providing an elongated sheet metal strip (step 300); forming a first linear receiving slot along a first lengthwise outer flange bend line and at an end of the sheet metal strip (step 310); forming a second linear receiving slot along a second lengthwise outer flange bend line and at the end of the sheet metal strip that has the first receiving slot (step 320); bending the sheet metal strip along the first lengthwise outer bend line to define a first flange and a first outer flange angle (step 330); bending the sheet metal strip along a central bend line to define a first and second elongated web adjoined along a central angle (step 340); and bending the sheet metal strip along the second lengthwise outer bend line to define a second flange and a second outer flange angle (step 350).

Figure 15:
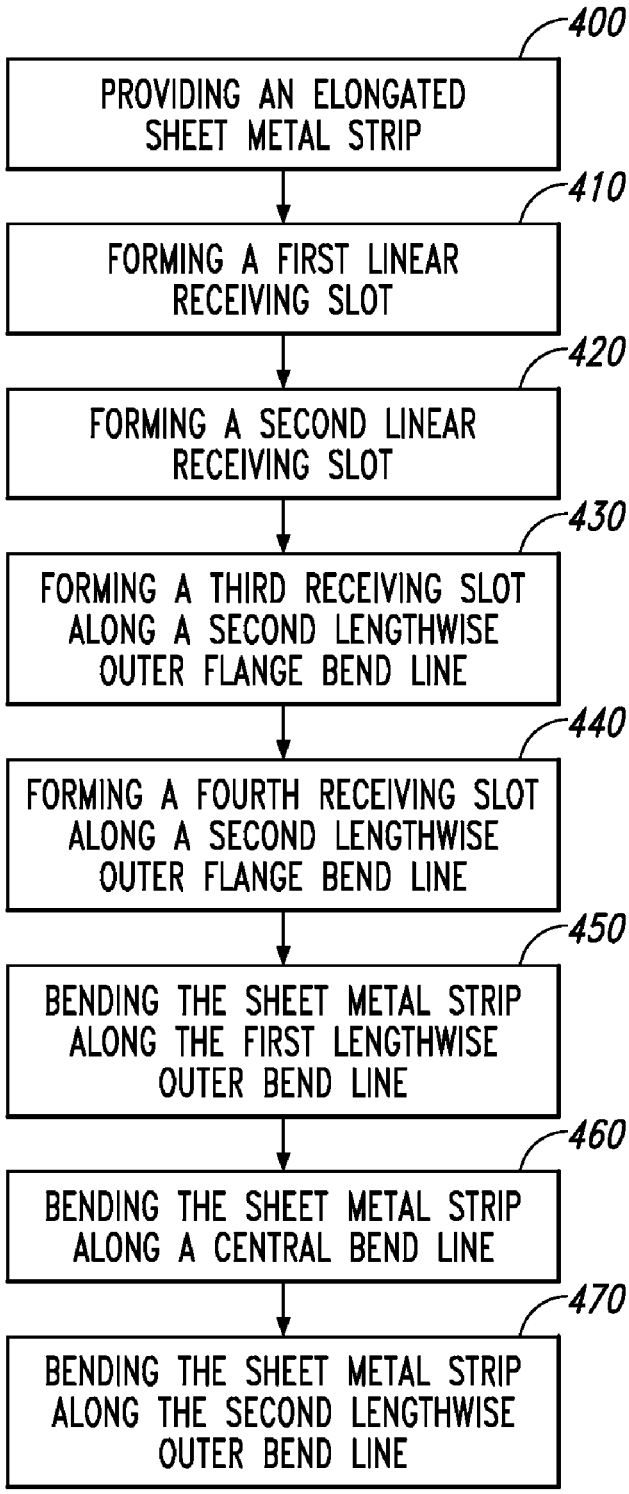
FIG. 15 depicts a process flow diagram associated with a method for making an inside corner framing element in accordance with the fourth embodiment of the present invention.
Figure 16:
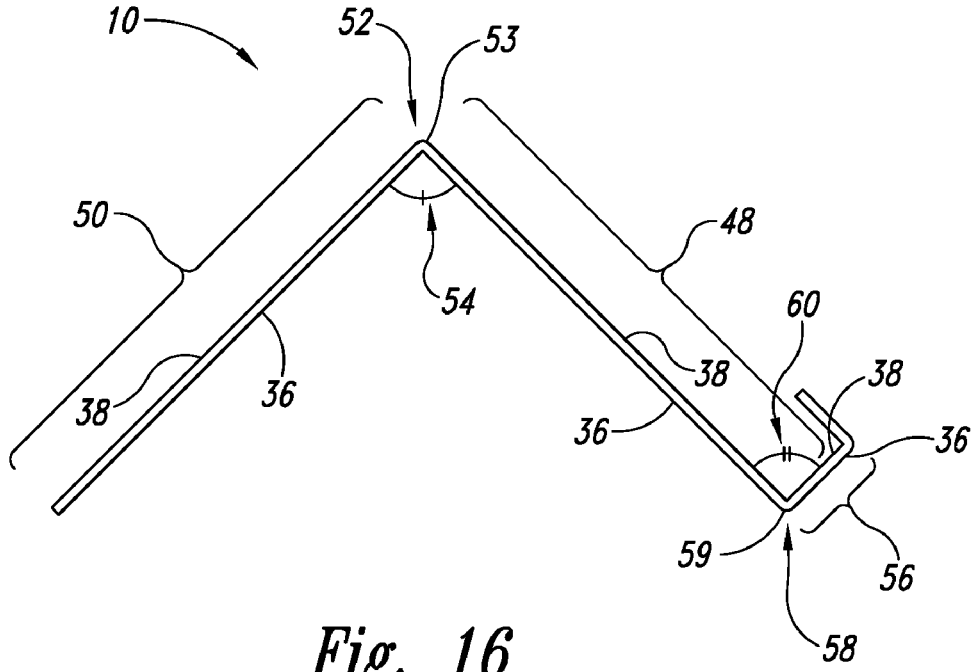
FIG. 16 illustrates a cross-sectional view of a further embodiment of the inside corner framing element of FIGS. 4A-B, but wherein the outer flange has a return lip substantially parallel to the first web.
Figure 17:
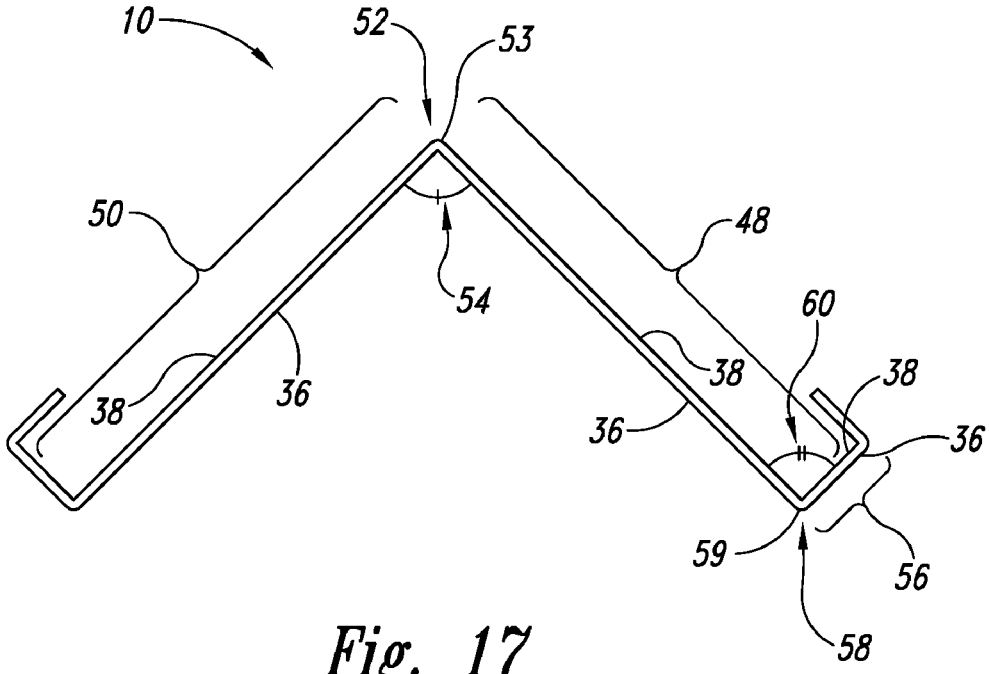
FIG. 17 illustrates a cross-sectional view of a further embodiment of the inside corner framing element of FIGS. 8A-B, but wherein the first outer flange has a first return lip substantially parallel to the first web, and the second outer flange has a second return lip substantially parallel to the second web.

As depicted in FIG. 15, the method in still yet another embodiment (corresponding to the structure of the fourth embodiment shown in FIGS. 10 and FIGS. 11A-C) comprises at least the steps of: providing an elongated sheet metal strip (step 400); forming a first linear receiving slot along a first lengthwise outer flange bend line and at an end of the sheet metal strip (step 410); forming a second linear receiving slot along a second lengthwise outer flange bend line and at the end of the sheet metal strip that has the first receiving slot (step 420); forming a third linear receiving slot along a second lengthwise outer flange bend line and at the end of the sheet metal strip that is opposite the end that has the first receiving slot (step 430); forming a fourth linear receiving slot along the second lengthwise outer flange bend line and at the end of the sheet metal strip that is opposite the end that has the third receiving slot (step 440); bending the sheet metal strip along the first lengthwise outer bend line to define a first flange and a first outer flange angle (step 450); bending the sheet metal strip along a central bend line to define a first and second elongated web adjoined along a central angle (step 460); and bending the sheet metal strip along the second lengthwise outer bend line to define a second flange and a second outer flange angle (step 470).

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing descriptions, and all changes that come within the meaning and range of equivalency of the claims are to be embraced within their scope.

What is claimed is:

1. An inside corner framing element for supporting wallboard, the inside corner framing element being configured to vertically fit along an inside corner formed at the intersection of two adjoining walls, with each wall being of framed construction defined by generally confronting U-shaped sheet metal header and footer tracks having a plurality of vertically positioned studs therebetween, the U-shaped sheet metal header and footer tracks having respective downwardly and upwardly extending side walls that retain the plurality of studs, the inside corner framing element comprising:

an elongated sheet metal strip having an inner and outer surface, an upper and lower end, and at least three lengthwise interior bends, the at least three lengthwise interior bends being substantially parallel to one another and defining (i) a first and second elongated web adjoined along a central web bend line, (ii) a central web angle between the inner surfaces of the first and second elongated web, with the central web angle being selected from an obtuse angle, a right angle, and an acute angle, (iii) a first elongated flange adjoined to the first elongated web along a first outer flange bend line, and (iv) a first outer flange angle between the outer surfaces of the first elongated flange and the first elongated web, with the first outer flange angle being selected from an obtuse angle, a right angle, and an acute angle (v) a second elongated flange adjoined to the second elongated web along a second outer flange bend line, and (vi) a second outer flange angle between the outer surfaces of the second elongated flange and the second elongated web, with the second outer flange angle being selected from an obtuse angle, a right angle, and an acute angle; and a first receiving slot for engaging the inside corner framing element to either a downwardly or upwardly directed side wall of the respective header and footer tracks, the first receiving slot being positioned at either the upper end or the lower end of the elongated sheet metal strip, wherein the first receiving slot is longitudinally positioned along the first outer flange bend line.

2. The inside corner framing element of claim 1 wherein the first receiving slot is linear.

3. The inside corner framing element of claim 1, further comprising a second receiving slot for engaging the corner framing element to either a downwardly or upwardly directed side wall of the respective header and footer tracks, the second receiving slot being positioned at the end of the elongated sheet metal strip that is opposite from the position of the first receiving slot.

4. The inside corner framing element of claim 3 wherein the central web angle is a right angle.

5. The inside corner framing element of claim 4 wherein the first outer flange angle is a right angle.

6. The inside corner framing element of claim 3, further comprising a third receiving slot for engaging the inside corner framing element to either a downwardly or upwardly directed side wall of the respective header and footer tracks, the third receiving slot being positioned at the upper end of the elongated sheet metal strip and along the second outer flange bend line.

7. The inside corner framing element of claim 6, further comprising a fourth receiving slot for engaging the inside corner framing element to either a downwardly or upwardly directed side wall of the respective header and footer tracks, the fourth receiving slot being positioned at the lower end of the elongated sheet metal strip and along the second outer flange bend line.

8. An inside corner framing element for supporting wallboard, the corner framing element being configured to vertically fit along an inside corner formed at the intersection of two adjoining walls, with each wall being of framed construction defined by generally confronting U-shaped sheet metal header and footer tracks having a plurality of a vertically positioned studs therebetween, the U-shaped sheet metal header and footer tracks having respective downwardly and upwardly directed side walls that retain the plurality of studs, the inside corner framing element comprising:

an elongated sheet metal strip having an inner and outer surface, an upper and lower end, and at least three lengthwise interior bends, the at least three lengthwise interior bends being substantially parallel to one another and defining (i) a first and second elongated web adjoined along a central web bend line, (ii) a central web angle between the inner surfaces of the first and second elongated web, with the central web angle being selected from an obtuse angle, a right angle, and an acute angle, (iii) a first elongated flange adjoined to the first elongated web along a first outer flange bend line, and (iv) a first outer flange angle between the outer surfaces of the first elongated flange and the first elongated web, with the first outer flange angle being selected from an obtuse angle, a right angle, and an acute angle, (v) a second elongated flange adjoined to the second elongated web along a second outer flange bend line, and (vi) a second outer flange angle between the outer surfaces of the second elongated flange and the second elongated web, with the second outer flange angle being selected from an obtuse angle, a right angle, and an acute angle;

a first linear receiving slot for engaging the inside corner framing element to either a downwardly or upwardly directed side wall of the respective header and footer tracks, the first linear receiving slot being positioned along the first outer flange bend line at the upper end of the elongated sheet metal strip; and a second linear receiving slot for engaging the inside corner framing element to either a downwardly or upwardly directed side wall of the respective header and footer tracks, the second linear receiving slot being positioned along the first outer flange bend line at the lower end of the elongated sheet metal strip.

9. The inside corner framing element of claim 8, further comprising:

a third linear receiving slot for engaging the inside corner framing element to either a downwardly or upwardly directed side wall of the respective header and footer tracks, the third linear receiving slot being positioned along the second outer flange bend line at the upper end of the elongated sheet metal strip; and a fourth linear receiving slot for engaging the inside corner framing element to either a downwardly or upwardly directed side wall of the respective header and footer tracks, the fourth linear receiving slot being positioned along the second outer flange bend line at the lower end of the elongated sheet metal strip.

10. An inside corner framing element for supporting wallboard, wherein the inside corner framing element is made from an elongated sheet metal strip having an inner and outer surface, and an upper and lower end; the inside corner framing element made from the method comprising:

providing the sheet metal strip;

forming a first linear receiving slot along a first lengthwise outer flange bend line and at the upper end of the sheet metal strip;

bending the sheet metal strip along the first lengthwise outer bend line to define a first flange and a first outer flange angle;

bending the sheet metal strip along a central bend line to define a first and second elongated web adjoined along a central angle;

forming a second linear receiving slot along a second lengthwise outer flange bend line and at the upper end of the elongated sheet metal strip; and bending the sheet metal strip along the second lengthwise outer bend line to define a second flange and a second outer flange angle.

11. The inside corner framing element of claim 10, further comprising forming a third linear receiving slot along the first lengthwise outer flange bend line and at the lower end of the elongated sheet metal strip; and forming a fourth linear receiving slot along the second lengthwise outer flange bend line and at the lower end of the elongated sheet metal strip.

* * * * *